US006793571B2

(12) United States Patent
Chung

(10) Patent No.: US 6,793,571 B2
(45) Date of Patent: Sep. 21, 2004

(54) SIZE-CHANGEABLE COIN BANK

(76) Inventor: Dong-Hwan Chung, Hyundae Apt., 110-704, Juoa-Dong, Haewoondae-Gu, Pusan-City (KR)

( * ) Notice: Subject to any disclaimer, the term of this patent is extended or adjusted under 35 U.S.C. 154(b) by 135 days.

(21) Appl. No.: 10/022,240

(22) Filed: Dec. 20, 2001

(65) Prior Publication Data

US 2003/0119438 A1 Jun. 26, 2003

(51) Int. Cl.[7] ..... G07D 9/04
(52) U.S. Cl. ..... 453/60; 446/8
(58) Field of Search ..... 453/60, 16, 39, 453/58, 61, 62; 446/8, 13; 150/150, 151

(56) References Cited

U.S. PATENT DOCUMENTS 1,407,140 A * 2/1922 Friesen ..... 453/60
2,150,473 A * 3/1939 Wagner ..... 53/254
2,490,275 A * 12/1949 Lepper ..... 446/8
RE24,355 E * 9/1957 Whalen ..... 46/2
4,036,358 A * 7/1977 Kelley ..... 206/0.82
4,244,157 A * 1/1981 Vondra et al. ..... 53/254
5,441,448 A * 8/1995 Yang ..... 453/60
6,109,996 A * 8/2000 Ma et al. ..... 446/8

* cited by examiner

*Primary Examiner*—Donald P. Walsh
*Assistant Examiner*—Mark J Beauchaine
(74) *Attorney, Agent, or Firm*—Burns, Doane, Swecker & Mathis, L.L.P.

(57) ABSTRACT

A size-changeable coin bank for counting coins comprises a main body having a cylinder with a coin slot and a funnel with a coin slot, the funnel screw-jointed to the cylinder, a counting cylinder inserted into the funnel and moved up and down, the counting cylinder having an open bottom, a scale marked on the outer surface and a metal lid attached to the top surface, wherein coins are inserted into the counting cylinder through the metal lid, and an ornament attached to the metal lid screw-jointed to the counting cylinder and having a metal coin. Herein the size of the coin bank is changeable by moving the counting cylinder up and down. The main body and/or the counting cylinders are polygonal. The cylinder, the funnel and the counting cylinders are made of a transparent material, and an advertisement paper or film is inserted into the inner or attached to the outer of the cylinder, the funnel and the counting cylinders. The coin bank further comprises a sensor or an IC chip for making a sound and lighting.

8 Claims, 2 Drawing Sheets

SIZE-CHANGEABLE COIN BANK

BACKGROUND OF THE INVENTION

1. Field of the Invention

The present invention relates to a coin bank, and more particularly to a size-changeable coin bank, which sorts and counts coins, with various ornaments such as dolls, animals or other character models.

2. Description of the Prior Art

Usually, conventional coin banks for depositing coins comprise a main body in various shapes such as animals or other characters and a coin slot. Various coins are unsorted and collectively deposited within the coin bank. Therefore, the conventional coin banks are inconvenient to sort and count coins of varying diameters, i.e., 10 won, 50 won, 100 won and 500 won. Further, the conventional coin banks are not sufficient as decorations.

SUMMARY OF THE INVENTION

Accordingly, an object of the present invention is to provide a coin bank comprising a counting cylinder with a coin slot detachably attached to a main body, thereby resulting in serving as a counting means after collecting coins.

Another object of the present invention is to provide a coin bank, whose size is changeable by moving the counting cylinder up and down.

Still another object of the present invention is to provide an ornamental coin bank with an ornament such as animal shapes or varying decorations attached to the upper surface of the counting cylinder.

In order to achieve the foregoing and other objects, the present invention provides size-changeable coin bank for counting coins, comprising a main body having a cylinder with a coin slot and a funnel with a coin slot, the funnel screw-jointed to the cylinder, a counting cylinder inserted into the funnel and moved up and down, the counting cylinder having an open bottom, the scale marked on the outer surface and a metal lid attached to the top surface, wherein coins are inserted into the counting cylinder through the metal lid, and an ornament attached to the metal lid screw-jointed to the counting cylinder and having a coin slot. Herein the size of the coin bank is changeable by moving the counting cylinder up and down.

In another aspect of the present invention, a size-changeable coin bank for counting coins comprises a main body having a plurality of cylinders, each with a closed bottom and an open top and screw-jointed to each other, and a funnel screw-jointed to the uppermost cylinder, a central counting cylinder screw-jointed to the top of the funnel, the central counting cylinder having the scale marked on the outer surface for counting at least one type of the coins, side counting cylinders formed on both sides of the central counting cylinder and screw-jointed to the top of the funnel, and an ornament screw-jointed to the top surfaces of the central and side counting cylinders and having a body with a inner cavity and a coin slot, and a funnel detachably attached to the body of the ornament by an interconnection means.

The main body and/or the counting cylinders are polygonal.

Preferably, the cylinder, the funnel and the counting cylinders are made of a transparent material, and an advertisement paper or film is inserted into the interior or attached to the exterior of the cylinder, the funnel and the counting cylinders. Further, the coin bank further preferably comprises a sensor or an IC chip for making a sound and lighting.

BRIEF DESCRIPTION OF THE DRAWINGS

These and other objects, features and advantages of the present invention will be readily understood with reference to the following detailed description thereof provided in conjunction with the accompanying drawings, wherein like reference numerals designate like structural elements, and, in which.

DETAILED DESCRIPTION OF THE PREFERRED EMBODIMENT

Preferred embodiments of the present invention will be described below with reference to the accompanying drawings.

Figure 1:
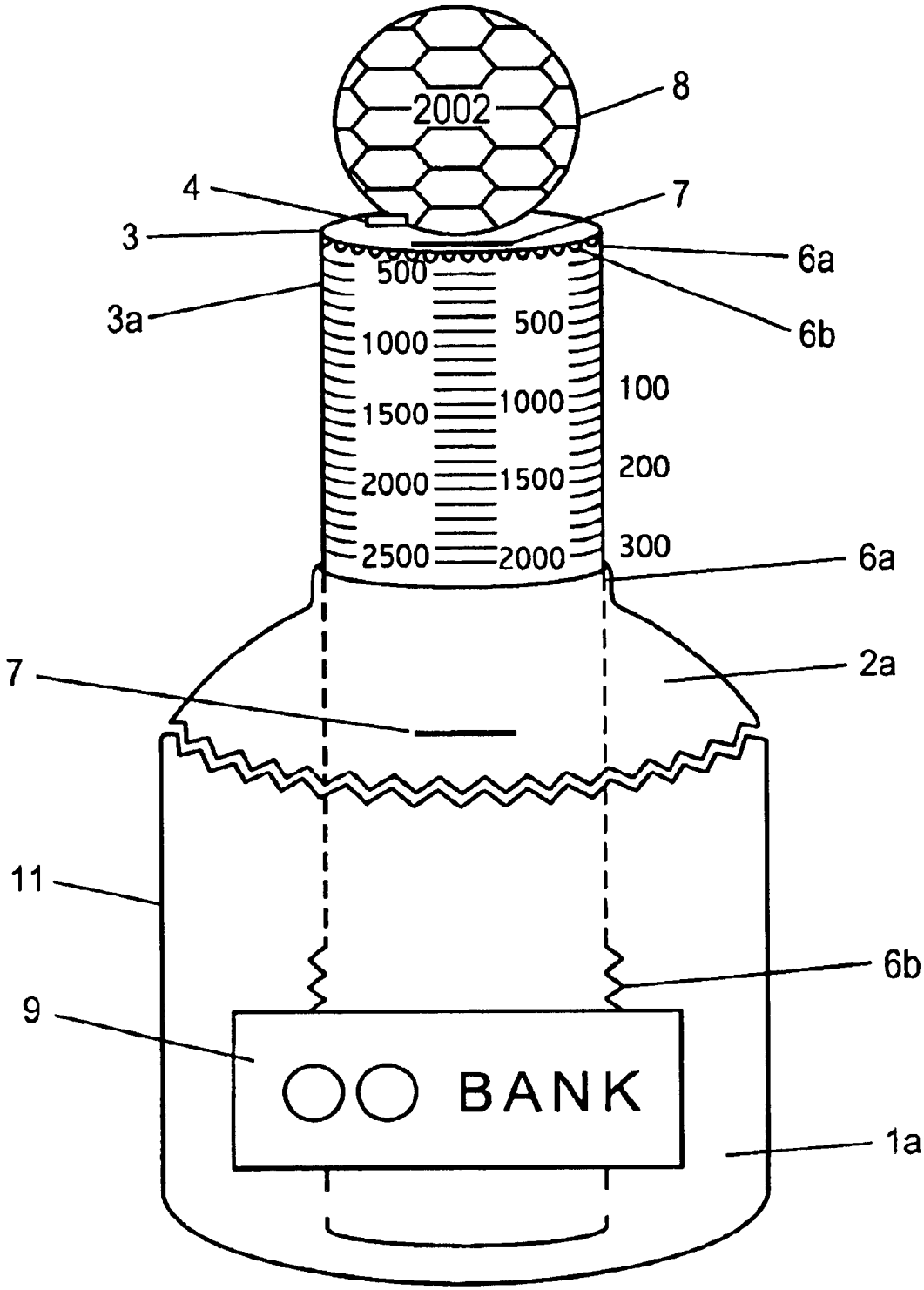
FIG. 1 is a perspective view of a coin bank in accordance with an embodiment of the present invention.

FIG. 1 is a perspective view of a coin bank in accordance with an embodiment of the present invention.

As shown in FIG. 1, a coin bank of an embodiment of the present invention comprises a main body 11 having a cylinder 1*a* with a closed bottom and a funnel 2*a*, a transparent counting cylinder 3*a* having an external screw 6*b* formed at the bottom surface and a metal lid 3 with a coin slot 7 screw-jointed to the top surface, and an ornament 8. The main body 11 is made of a transparent synthetic resin, a wood, or a steel. The main body 11 and the counting cylinder 3*a* may be cylindrical or polygonal, except for the screw-jointed area.

An internal screw 6*a* is formed on the top surface of the cylinder 1*a*, and an external screw 6*b* is formed on the bottom surface of the funnel 2*a*. The external screw 6*b* is detachably jointed to the internal screw 6*a*, thereby forming the main body 11.

An internal screw 6*a* is formed on the top surface of the funnel 2*a*.

The counting cylinder 3*a* is inserted into the top of the funnel 2*a*. Herein, the scale for representing the number of the deposited coins, i.e., by 10 won unit, by 100 won unit or by 500 won unit, is marked on the outer wall of the counting cylinder 3*a*. Prior to jointing the funnel 2*a* to the cylinder 1*a*, the counting cylinder 3*a* provided with the metal lid 3 is inserted into the top of the funnel 2*a*.

The bottom surface of the counting cylinder 3*a* with an external screw 6*b* has a diameter enough to be suitably jointed to an internal screw 6*a* of the top surface of the funnel 2*a*. Thereby, the counting cylinder 3*a* in a forward direction is not separated from the funnel 2*a*. However, after detaching the funnel 2*a* from the cylinder 1*a* of the main body 11, the counting cylinder 3*a* in a backward direction is separated from the funnel 2*a*.

Therefore, when the main body 11 is filled with coins, the counting cylinder 3*a* is pulled out, thereby resulting in additionally collecting more coins. After collecting coins, when the deposited coins are extracted to be counted, the counting cylinder 3*a* is separated from the funnel 2*a* in a backward direction and the internal screw 6*a* on the top of the funnel 2*a* is jointed to the external screw 6*b* of the counting cylinder 3*a*. Then, coins are stacked within the counting cylinder 3*a*. Therefore, the coin bank of the present invention easily counts the deposited coins.

An ornament 8 with a permanent magnet 4 attached to the bottom is attached to the top surface of the metal lid 3. For example, the ornament 8 may be a football or various animal decorations and magnetically attached to the metal lid 9.

An internal screw 6*a* is formed on the inner wall of the metal lid 3 and screw-jointed to the external screw 6*b* on the top of the counting cylinder 3*a*.

The coin slot 7 and a hole for receiving writing means such as pencils are formed on the outer surface of the funnel 2*a*. A film for advertisement may be attached to the outer surface of the cylinder 1*a*.

Figure 2:
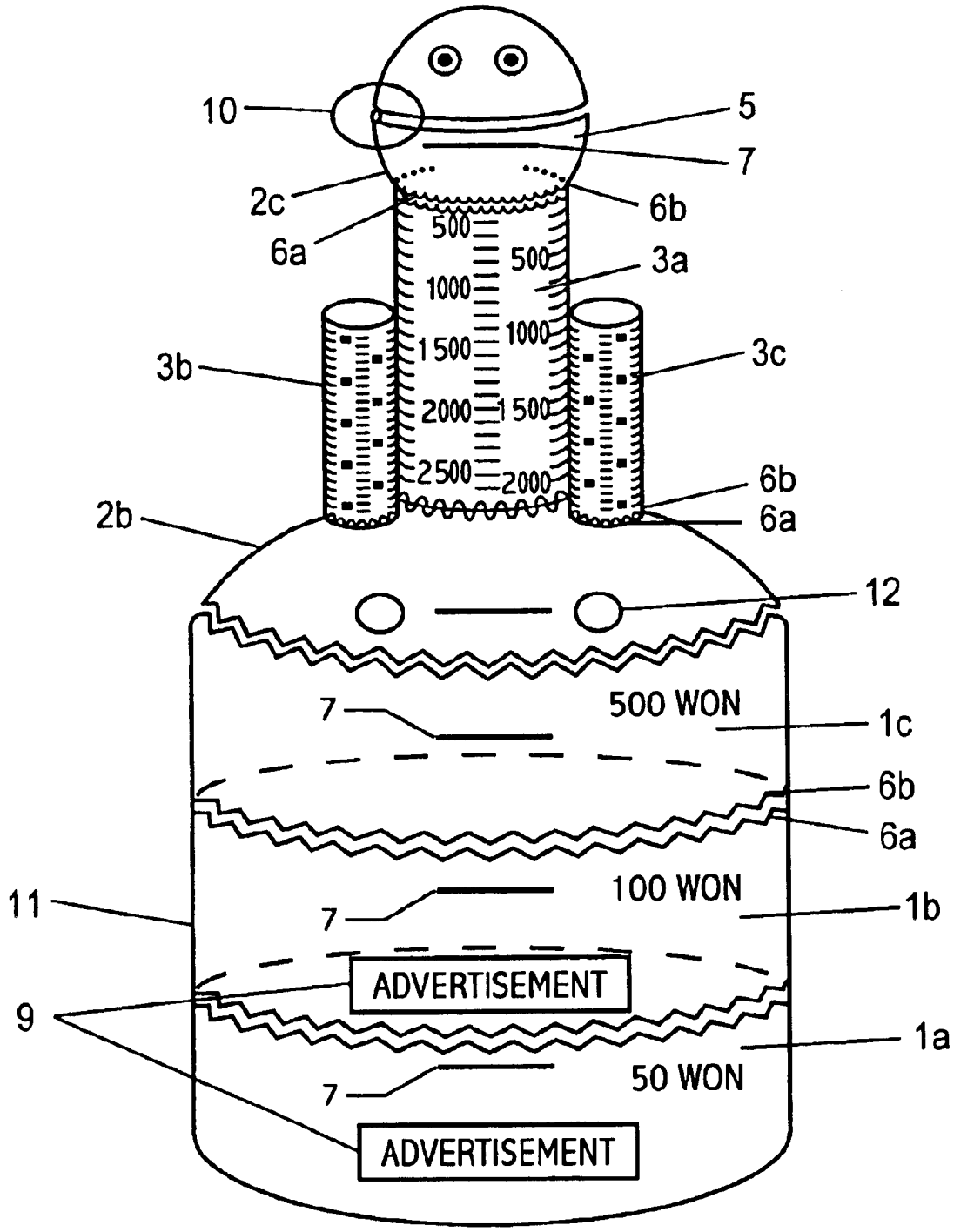
FIG. 2 is a perspective view of a coin bank in accordance with another embodiment of the present invention.

If the cylinder 1*a* is made of a transparent material, an elastic advertisement film 9 is put in the cylinder 1*a* and adhered closely to the inner wall of the cylinder 1*a* by pressing the deposited coins, thereby enhancing the commercial effect, FIG. 2 is a perspective view of a coin bank in accordance with another embodiment of the present invention.

As shown in FIG. 2, the cylinder of the main body 11 comprises three parts 1*a*, 1*b*, and 1*c*, thereby sorting out coins of varying diameters into 50 won, 100 won and 500 won, and each cylinder 1*a*, 1*b* and 1*c* has a closed bottom surface and a coin slot 7 respectively. The lowermost cylinder 1*a* has an internal screw 6*a* on the top surface. The internal screw 6*a* of the lowermost cylinder 1*a* is jointed to the external screw 6*b* of the middle cylinder 1*b*. Also, the middle cylinder 1*b* has an internal screw 6*a* on the top surface, thereby jointed to the external screw 6*b* of the uppermost cylinder 1*c*.

The uppermost cylinder 1*c* has an internal screw 6*a* on the top surface. The external screw 6*b* of the bottom of a funnel 2*b* is jointed to the internal screw 6*a* of the uppermost cylinder 1*c*.

The funnel 2*b* has an internal screw 6*a* on the outer surface of the top of the funnel 2*b*. At least one counting cylinder 3*a*, 3*b*, and 3*c* with a closed bottom surface and an external screw 6*b* is screw-jointed to the funnel 2*b*. That is, the main body 11 and the counting cylinders 3*a*, 3*b* and 3*c* can collect and sort varying coins. An ornament 5 comprises a coin slot 7 and an inner cavity. The ornament 5 is detachably attached to a funnel 2*c* by an interconnection means 10. Thereby, after separating the ornament 5 from the funnel 2*c*, the deposited coins are stacked within the counting cylinder 3*a* through the funnel 2*c*, thereby calculating the total amount of the coins.

On both sides of the central counting cylinder 3*a*, side counting cylinders 3*b* and 3*c* with the scale marked on the outer surface are formed. The side counting cylinders 3*b*, 3*c* are also detachably screw-jointed to the funnel 2*b*.

The central counting cylinder 3*a* has an internal screw 6*a* on the top and the side counting cylinders 3*b*, 3*c* also has an internal screw 6*a* on the top, respectively. Various ornaments with a coin slot and inner cavity may be detachably attached to the side counting cylinders 3*b*, 3*c* by the interconnection means 10. In counting coins, the counting cylinders 3*a*, 3*b* and 3*c* are separated from the funnel 2*b* and the ornament 5 is separated from the counting cylinders 3*a*, 3*b* and 3*c*. Then the deposited coins are stacked within the counting cylinder 3*a*, 3*b* and 3*c* through the funnel 2*c*, thereby calculating the total amount of the coins.

As described above, the main body 11 and the counting cylinders 3*a*, 3*b* and 3*c* are made of a transparent material. Therefore, an elastic advertisement film 9 is inserted into or attached to the main body 11 and/or the counting cylinders 3*a*, 3*b* and 3*c*, thereby obtaining the commercial effect, Additionally, a sensor or IC chips for making a sound or lighting by the contact or the weight of the coins may be attached to the inner of the main body 11.

With the structure of the coin bank of the preferred embodiments of the present invention, the counting cylinder is screw-jointed to the main body and moves up and down, thereby variously changing the size of the coin bank.

Furthermore, the deposited coins are collectively sorted by types of the coins. Therefore, the present invention minimizes the time and effort of counting coins.

An advertisement paper or film is inserted into the inner or attached to the outer of the coin bank, thereby obtaining the commercial effect.

Moreover, an ornament such as a football or various animal decorations is attached to the coin bank, then providing an aesthetic appreciation and further encouraging children in savings.

Although the preferred embodiments of the present invention have been described in detail hereinabove, it should be understood that many variations and/or modifications of the basic inventive concepts herein taught which may appear to those skilled in the art will still fall within the spirit and scope of the present invention as defined in the appended claims.

What is claimed is:

1. A size-changeable coin bank for counting coins, said coin bank comprising:

a main body having a cylinder with a coin slot and a funnel with a coin slot, said funnel screw-jointed to said cylinder;

a counting cylinder inserted into said funnel and moved up and down, said counting cylinder having an open bottom, a scale marked on the outer surface and a metal lid attached to the top surface, wherein coins are inserted into said counting cylinder through said metal lid; and an ornament attached to said metal lid screw-jointed to said counting cylinder said metal lid having a coin slot wherein the size of said coin bank is changeable by moving said counting cylinder up and down.

2. The size-changeable coin bank for counting coins as claimed in claim 1, wherein said main body or said counting cylinder are polygonal.

3. The size-changeable coin bank for counting coins as claimed in claim 1, wherein said cylinder, said funnel and said counting cylinder are made of a transparent material, and an advertisement paper or film is inserted into the interior or attached to the exterior of said cylinder, said funnel and said counting cylinder.

4. The size-changeable coin bank for counting coins as claimed in claim 1, further comprising a sensor or an IC chip for making a sound and lighting.

5. A size-changeable coin bank for counting coins, said coin bank comprising:

a main body having a plurality of cylinders, each with a closed bottom and an open top and screw-jointed to each other, and a funnel screw-jointed to the uppermost cylinder;

a central counting cylinder adjustably screw-jointed to the top of said funnel, said central counting cylinder having a scale marked on the outer surface for counting at least one type of the coins;

side counting cylinders formed on both sides of said central counting cylinder and screw-jointed to the top of said funnel; and an ornament screw-jointed to the top surfaces of said central and side counting cylinders and having a body with a inner cavity and a coin slot, and a funnel detachably attached to the body of said ornament by an interconnection means.

6. The size-changeable coin bank for counting coins as claimed in claim 5, wherein said main body or said counting cylinders are polygonal.

7. The size-changeable coin bank for counting coins as claimed in claim 5, wherein said cylinders, said funnel and said counting cylinders are made of a transparent material, and an advertisement paper or film is inserted into the interior or attached to the exterior of one or more of said cylinders, said funnel and said counting cylinders.

8. The size-changeable coin bank for counting coins as claimed in claim 5, further comprising a sensor or an IC chip for making a sound and lighting.

* * * * *